US007055421B2

(12) United States Patent
Kash

(10) Patent No.: US 7,055,421 B2
(45) **Date of Patent: *Jun. 6, 2006**

(54) WELL PERFORATING GUN

(76) Inventor: Edward Cannoy Kash, 11660 Brittmore Park Dr., Houston, TX (US) 77041

( * ) Notice: Subject to any disclaimer, the term of this patent is extended or adjusted under 35 U.S.C. 154(b) by 7 days.

This patent is subject to a terminal disclaimer.

(21) Appl. No.: 10/611,188

(22) Filed: Jul. 1, 2003

(65) Prior Publication Data

US 2004/0216633 A1 Nov. 4, 2004

Related U.S. Application Data

(63) Continuation-in-part of application No. 10/370,142, filed on Feb. 18, 2003, now Pat. No. 6,865,978.

(51) Int. Cl.
*E21B 43/116* (2006.01)

(52) U.S. Cl. ..... 89/1.15; 102/313; 175/2

(58) Field of Classification Search ..... 89/1.15; 175/2, 3, 3.5, 4, 4.51, 4.6, 4.53; 166/297; 102/311, 312, 331
See application file for complete search history.

(56) References Cited

U.S. PATENT DOCUMENTS

| | | | | |
|---|---|---|---|---|
| 2,649,046 | A | 8/1953 | Davis | 102/310 |
| 2,750,885 | A | 6/1956 | Schlumberger | 175/4.6 |
| 2,980,017 | A | 4/1961 | Castel | 175/4.6 |
| 5,775,426 | A * | 7/1998 | Snider et al. | 166/308.1 |
| 5,960,894 | A * | 10/1999 | Lilly et al. | 175/4.6 |
| 6,158,511 | A * | 12/2000 | Wesson | 166/308.1 |
| 6,220,355 | B1 * | 4/2001 | French | 166/297 |
| 6,295,912 | B1 * | 10/2001 | Burleson et al. | 89/1.15 |
| 6,336,506 | B1 * | 1/2002 | Wesson | 166/308.1 |
| 6,520,258 | B1 | 2/2003 | Yang | 166/297 |
| 6,679,327 | B1 * | 1/2004 | Sloan et al. | 166/297 |
| 6,865,978 | B1 * | 3/2005 | Kash | 89/1.15 |
| 2002/0134585 | A1 | 9/2002 | Walker | 175/4.51 |

* cited by examiner

*Primary Examiner*—Michael J. Carone
*Assistant Examiner*—James S. Bergin
(74) *Attorney, Agent, or Firm*—Buskop Law Group,P.C.; Wendy Buskop

(57) ABSTRACT

A perforating device having a longitudinal axis comprising: a loading tube having an explosive charge; a first layer slidable, non fixedly, and removeably disposed over the loading tube; and at least one outer layer in fixed engagement over the first layer and wherein the outer layer is a solid structure.

41 Claims, 13 Drawing Sheets

WELL PERFORATING GUN

This application is a continuation-in-part of application of Ser. No. 10/370,142 filed Feb. 18, 2003, now U.S. Pat. No. 6,865,978 Entitled, "WELL PERFORATING GUN".

BACKGROUND

Well completion techniques normally require perforation of the ground formation surrounding the borehole to facilitate the flow if interstitial fluid (including gases) into the hole so that the fluid can be gathered. In boreholes constructed with a casing such as steel, the casing must also be perforated. Perforating the casing and underground structures can be accomplished using high explosive charges. The explosion must be conducted in a controlled manner to produce the desired perforation without destruction or collapse of the well bore.

Hydrocarbon production wells are usually lined with steel casing. The cased well, often many thousands of feet in length, penetrates varying strata of underground geologic formations. Only a few of the strata may contain hydrocarbon fluids. Well completion techniques require the placement of explosive charges within a specified portion of the strata. The charge must perforate the casing wall and shatter the underground formation sufficiently to facilitate the flow of hydrocarbon fluid into the well as shown in FIG. 1. However, the explosive charge must not collapse the well or cause the well casing wall extending into a non-hydrocarbon containing strata to be breached. It will be appreciated by those skilled in the industry that undesired salt water is frequently contained in geologic strata adjacent to a hydrocarbon production zone, therefore requiring accuracy and precision in the penetration of the casing.

The explosive charges are conveyed to the intended region of the well, such as an underground strata containing hydrocarbon, by multi-component perforation gun system ("gun systems," or "gun string". The gun string is typically conveyed through the cased well bore by means of coiled tubing, wire line, or other devices, depending on the application and service company recommendations. Although the following description of the invention will be described in terms of existing oil and gas well production technology, it will be appreciated that the invention is not limited to those application.

Typically, the major component of the gun string is the "gun carrier" tube component (herein after called "gun") that houses multiple shaped explosive charges contained in lightweight precut "loading tubes" within the gun. The loading tubes provide axial circumferential orientation of the charges within the gun (and hence within the well bore). The tubes allow the service company to preload charges in the correct geometric configuration, connect the detonation primer cord to the charges, and assemble other necessary hardware. The assembly is then inserted into the gun as shown in FIG. 2. Once the assembly is complete, other sealing connection parts are attached to the gun and the completed gun string is lowered into the well bore by the conveying method chosen.

The gun is lowered to the correct down-hole position within the production zone, and the chares are ignited producing an explosive high-energy jet of very short duration (see FIG. 3). This explosive jet perforates the gun and well casing while fracturing and penetrating the producing strata outside the casing. After detonation, the expended gun string hardware is extracted form the well or release remotely to fall to the bottom of the well. Oil or gas (hydrocarbon fluids) then enters the casing through the perforations. It will be appreciated that the size and configuration of the explosive charge, and thus the gun string hardware, may vary with the size and composition of the strata, as well as the thickness and interior diameter of the well casing.

Currently, cold-drawn or hot-drawn tubing is used for the gun carrier component and the explosive charges are contained in an inner, lightweight, precut loading tube. The gun is normally constructed from a high-strength alloy metal. The gun is produced by machining connection profiles on the interior circumference of each of the guns ends and "scallops," or recesses, cut along the gun's outer surface to allow protruding extensions ("burrs") created by the explosive discharge through the gun to remain near or below the overall diameter of the gun. This method reduces the chance of burrs inhibiting extraction or dropping the detonated gun. High strength materials are used to construct guns because they must withstand the high energy expended upon detonation. A gun must allow explosions to penetrate the gun body, but not allow the tubing to split or otherwise lose its original shape Extreme distortion of the gun may cause it to jam within the casing. Use of high strength alloys and relatively heavy tube wall thickness has been used to minimize this problem.

Guns are typically used only once. The gun, loading tube, and other associated hardware items are destroyed by the explosive charge. Although effective, guns are relatively expensive. Most of the expense involved in manufacturing guns is the cost of material. These expenses may account for as much as 60% or more of the total cost of the gun. The oil well service industry has continually sought a method or material to reduce the cost while also seeking to minimize the possibility of misdirected explosive discharges or jamming of the expended gun within the well.

Although the need to ensure gun integrity is paramount, efforts have made to use lower cost steel alloys through heat-treating, mechanical working, or increasing wall thickness in lower-strength but less expensive materials. Unfortunately, these efforts have seen only limited success. Currently, all manufacturers of guns are using some variation of high strength, heavy-wall metal tubes.

SUMMARY OF INVENTION

The invention relates to a perforating device having a longitudinal axis comprising: a loading tube having an explosive charge; a first layer slidable, non fixedly, and removeably disposed over the loading tube; and at least one outer layer in fixed engagement over the first layer, and wherein the outer layer is a solid structure. The invention disclosed herein also relates to a perforating device having a longitudinal axis and a horizontal axis comprising: a loading tube having an explosive charge; a first layer slidable, non fixedly and removeably disposed over the loading tube; and at least one outer wire layer wound over the first layer and wherein the outer layer is wire.

BRIEF DESCRIPTION OF THE DRAWINGS

The accompanying drawings, which are incorporated in and constitute a part of the specification, illustrate preferred embodiments of the invention. These drawings, together with the general description of the invention above and the detailed description of the preferred embodiments below, serve to explain the principals of the invention.

The above general description and the following detailed description are merely illustrative of the subject invention, additional modes, and advantages. The particulars of this invention will be readily suggested to those skilled in the art without departing from the spirit and scope of the invention.

DETAILED DESCRIPTION OF THE INVENTION

The invention disclosed herein provides for an improved well perforating gun.

According to the invention, the material, which can be steel or another metal, used in the gun has been improved to a set of desired characteristics.

In one embodiment, the gun is design with an improved ability to withstand high shocks delivered over very short periods of time ("impact strength") created by the simultaneous detonation of multiple explosive charges ("explosive energy pulse" or "pulse"). In essence, the impact strength normally associated with steels with 200 low carbon content and/or higher levels of other alloying elements, such as chromium and nickel is improved by using the design features of the invention.

In another embodiment, the overall strength of the gun is improved.

In a third embodiment, the ability of the gun to withstand the shock of the explosion from the gun by enabling the gun wall to transfer its energy immediately to the outside surface of the tubing quickly and smoothly has been improved. The invention reduces imperfections in the gun wall which can act as stress risers and initiate cracking and failure.

Figure 1:
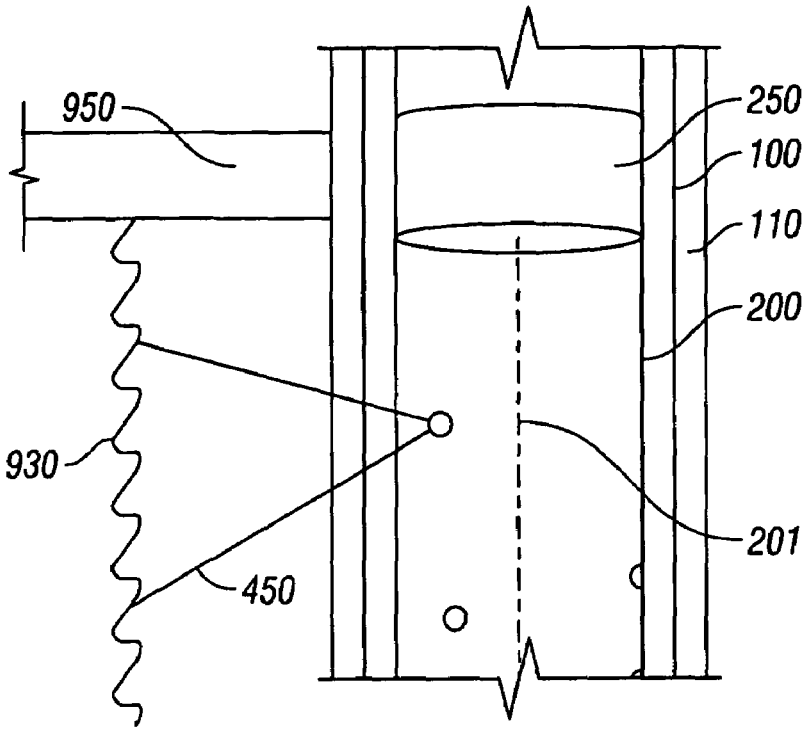
FIG. 1 is a side view of an embodiment of the invention in a well bore.

FIG. 1 is a side view of the invention. The gun 200 with a longitudinal axis 201 is suspended within the well bore 110 by a hanger 250 which can be a coil tube or a wire line. Charges 251, 251*a*, and 251*b* are contained within the gun and are oriented at 90 degrees intervals around the circumference of the gun as shown in FIG. 1A.

Figure 1A:
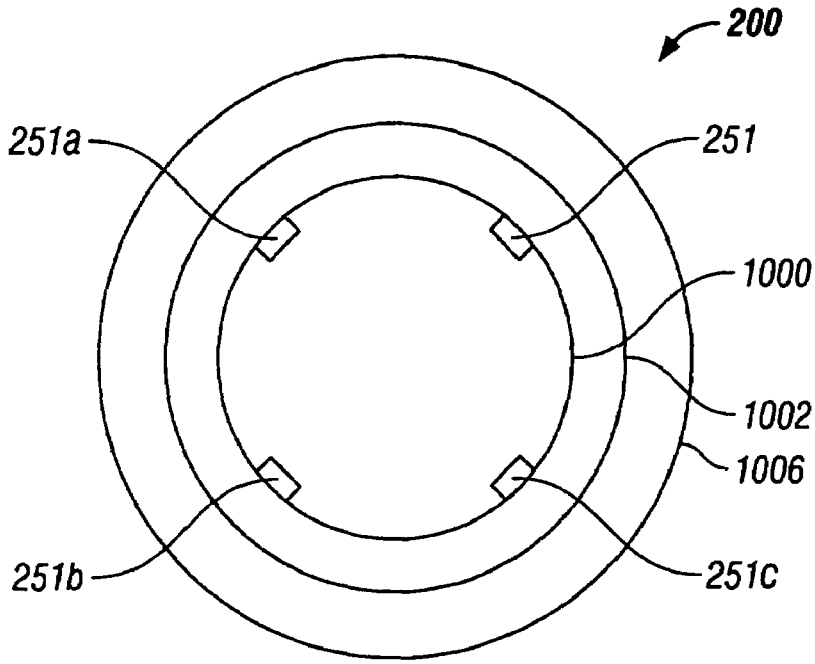
FIG. 1A is a cross sectional view of the invention with two layers.

In the cross sectional view of FIG. 1A, the gun 200 is shown with a first layer 1002 welded to an outer layer 1006, and a loading tube inserted within the first layer 1002.

Charges 251, 251*a*, 251*b* and 251*c* are disposed in the loading tubing in a helical arrangement. In an alternative embodiment, the outer layer is fixed to the first layer using an interference fit. It is also contemplated that this gun can have at least a third layer is disposed between first layer and the outer layer.

To function, the charges are detonated. FIG. 1, shows that upon detonation, an explosive gas jet 450 is produced by detonation of the charges 251, 251*a*, 251*b* and 251*c* as shown in FIG. 1A, and penetrates through the gun wall which is made from the first layer and the outer layer, at a minimum. In other embodiment of the invention, multiple layers can be used to form this gun wall.

The gas jet 450 not only penetrates the wall of the gun, but also penetrates the well casing 100 creating fractures 930 in the adjacent strata 950. Penetration of the gun wall is intended to occur at machined recesses which are termed "scallops" in the gun wall 210. The outer layer 1006 has scallop openings disposed in the solid structure. The scallops are positioned in the solid structure in a defined pattern. In the most preferred embodiment, the orientation of the outer layer is parallel to the longitudinal axis of the gun.

The scallops or recesses are fabricated in a selected pattern around the circumference of the gun in at least the outer layer. In the most preferred embodiment, the outer layer of the gun 1006 is a solid surface with scallops disposed therein. The scallop openings are preferably holes. In a preferred embodiment, there are at least 1 scallops per foot to 21 scallops per feet are disposed in the solid structure, and each hole has a diameter between ¼ inch and 1.5 inches.

It is desirable to use various arrangements or orientations of the charges ("shots") in the loading tube and to varying the numbers of charges within a given area ("shot density"). The variation permits changes in the effect and directionally of the explosive charges.

The explosive charges or "shots" can be arranged in a typically helical orientation around the wall of the gun 200. In alternative embodiments, the charges can be oriented in straight lines parallel to the axis 201 of the gun.

It should be noted that the outer layer and the first layer can be adhered together, such as using a binder or laminating agent disposed between the layers.

Guns are typically produced in increments of 5 feet, with the most common gun being about 20 feet. These guns may hold and fire as many as 21 charges for every foot of gun length. Perforation jobs may require multiple combinations of 20-foot sections, which are joined together end to end and by threaded screw-on connectors. The invention contemplates that at least two of the novel guns can be connected together, such as with seals, threaded connections or a similar securing devices.

Figure 2:
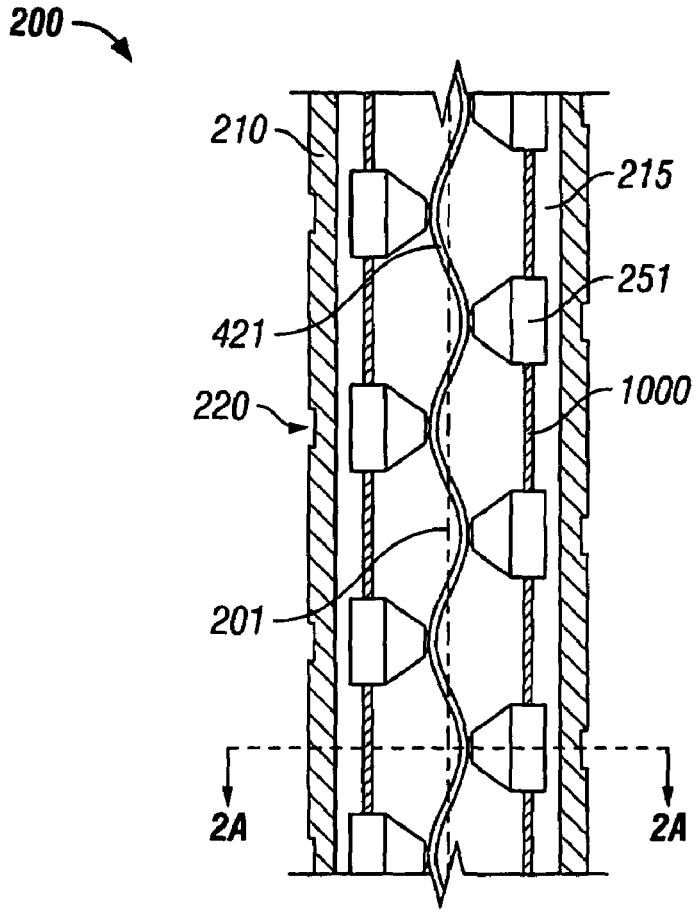
FIG. 2 is a side view of an embodiment of the invention.

FIG. 2 illustrates the basic components of the gun 200 and the relationships between the gun wall 210, loading tube 1000, charges 251, and detonation cord 421. The longitudinal axis 201 of the gun is parallel to the axis of the borehole as shown in FIG. 1. The line shown as 2A—2A illustrates the location of the sectional view depicted in FIG. 2A.

Figure 2A:
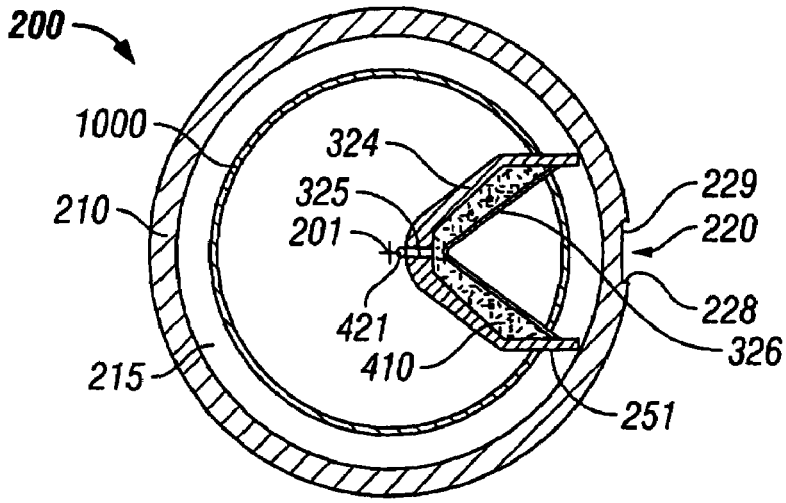
FIG. 2A is a top view of the gun of FIG. 2.

FIG. 2A is a sectional top view of the gun 200. The relationship of the gun wall 210 to the loading tube 1000, containing the charge 251, and the longitudinal axis 201 is illustrated. The loading tube and charge(s) are located within the annulus 215 of the gun wall 210. Also shown is a recess or scallop 220 machined into the outer surface of the gun wall at locations specified to be immediately adjacent to each explosive charge.

The charge 251 typically includes the explosive charge 410, shape charge body 324, primer vent 325 and retainer cone 326. It will be appreciated that the differing well conductions, casings, strata, and so on create the need for varying configurations and properties of the loading tubes, charges, and mounting hardware.

Figure 3:
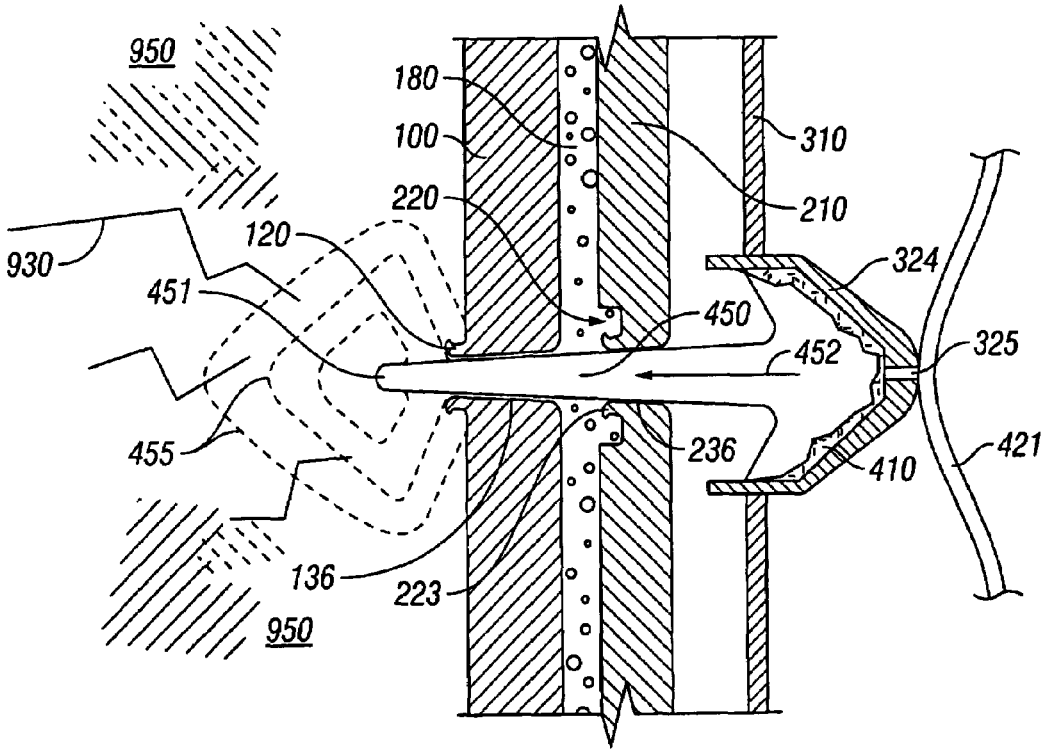
FIG. 3 illustrates an embodiment of the device comprised of an engineered sequence of layered materials.

The high-energy explosive gas jet 450 that is produced when a charge detonates is illustrated in FIG. 1 and FIG. 3. The duration of this explosive event is only of an extremely small fraction of a second and can be considered to be an explosive pulse occurring at detonation. During the violent and explosive energy pulse, the charge casing, loading tubes, and other gun components are subjected to an immediate, non-uniform change in pressure and temperature. The detonation cord 421 ignites the explosive 410 at the primer vent 325 within the non-combusting shaped charge body 324. The entire explosive within the charge ignites nearly instantaneously. Ignition within the shaped charge focuses an explosive jet 450 of expanding hot gas radially outward 452 toward the gun wall 210. The gun wall proximate to the short duration explosive jet or energy pulse contains a machined recess or scallop 220. The explosive jet 450 perforates through the machined scalloped gun wall (having decreased thickness) and continues through the narrow space between the gun wall 210 and the well casing 100. The explosive jet energy 450 also perforates the well casing 100. The energy of the jet creates one or more shock waves 455 that fracture 930 the geologic formation. It will be appreciated that the amount of energy required to penetrate the gun body is reduced by the thickness provided by the scallops.

The design criteria specified by the invention can be used to create an alternative gun tube construction that eliminates many of the problems and costs of the heavy walled tubing currently used. Although multiple embodiments of new gun material selection and construction are within the scope of this invention, attention should be first directed to the design and fabrication of gun tubing utilizing multiple layers of material. This method includes fabrication by layering or lamination of materials around a radius encompassing the longitudinal axis of the gun tube.

The gun can have a plurality of layers, for example if a third layer is used, it can be located between the first and outer layers and it can be a perforated sheet comprising a plurality of holes, wherein the holes comprise a diameter between 0.020 inches and 1 inch, and a density of approximately 1 to 700 holes per inch. In an alternative embodiment it is contemplated that the third layer is a solid sheet.

In yet another embodiment, it is contemplated that the gun can have a 4 layer construction, wherein a fourth layer is disposed between the third layer and the outer layer. It is contemplated that the fourth layer is a solid material. Alternatively, the fourth layer can be an energy absorbing layer is disposed between any two layers of the gun wall. It is contemplated that the energy absorbing layer is a perforated sheet or it can be a solid sheet. If it is a solid ship, it is contemplated that it can comprise lead, magnesium, copper, aluminum, and alloys thereof and a non-metallic substance, such as a ceramic, paper, cardboard, or a pressure laminate composite. If a perforated sheet is used as the energy absorbing layer, it is contemplated that it comprises lead, magnesium, copper, steel, stainless steel, aluminum, and alloys thereof.

The density per inch for the perforated sheet is contemplated to be between 1 hole per square inch and 700 holes per square inch wherein the diameter of the holes ranges between 0.020 inches and 1 inch.

The metal usable with the outer layer can have a tensile strength between 36 ksi and 400 ksi is contemplated for the first and outer layers. This metal can be a chrome alloy, a nickel alloy, a steel alloy, and combinations thereof.

It is also contemplated that the first and outer layers can comprise the same material.

Figure 4:
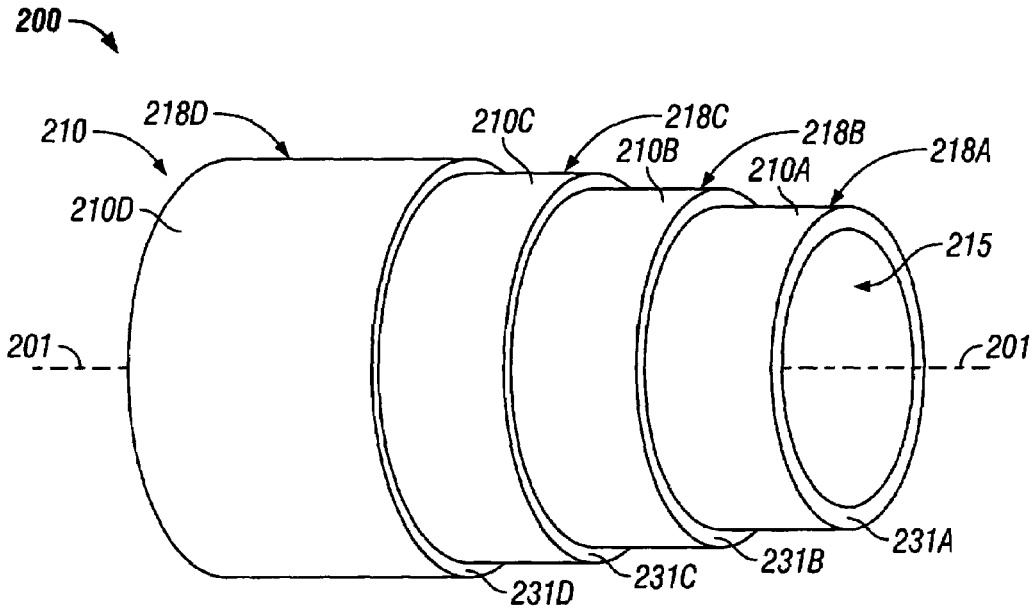
FIG. 4 illustrates an embodiment of the device of the invention showing use of perforated tubing, thereby eliminating machining of scallops.

FIG. 4 illustrates the construction of a gun wall 210 comprised of four material layers (210A, 210B, 210C and 210D). The orientation of each layer is parallel or at a constant radius to the longitudinal axis 201 of the gun (200) and the well bore (not shown). The thickness of each layer or tube 231D, 231C, 231B and 231A may be varied. The diameter of the annulus 215 formed within the inner tube may also be varied. The outer surface of each respective tube layer may be varied in construction to facilitate binding and retard delamination. Such designs may facilitate the strength characteristics of the gun wall in alternate directions, such as traverse or longitudinal directions. It is known that multi-layered constructions can have numerous advantageous over conventional, monolithic material constructions. It will be appreciated that this invention does not limit the number of layers, the composition of individual layers, or the manner in which layers are assembled or constructed. Further, the invention is not limited to the use of a binder or laminating agent between material layers; for example the outer surface 218A on the inner most layer 210A and the inner surface of the next out layer (not shown).

It will be appreciated that lamination of multiple layers of the same or differing materials may be used to enhance the performance over a single layer of material without increasing thickness. Use of fibrous materials, such as high strength carbon, graphite, silica based fibers and coated fibers are included within the scope of this invention. Although some embodiments may utilize one or more binding elements between one or more layers of material, the invention is not limited to the use of such binders. Plywood is an example of enhancing material properties by layering wood to produce a material that is superior to a solid wood board of equal thickness. Applications of multi-layered lamination can be subdivided into primary and complex designs. Additional embodiments of the invention are described below.

Figure 5:
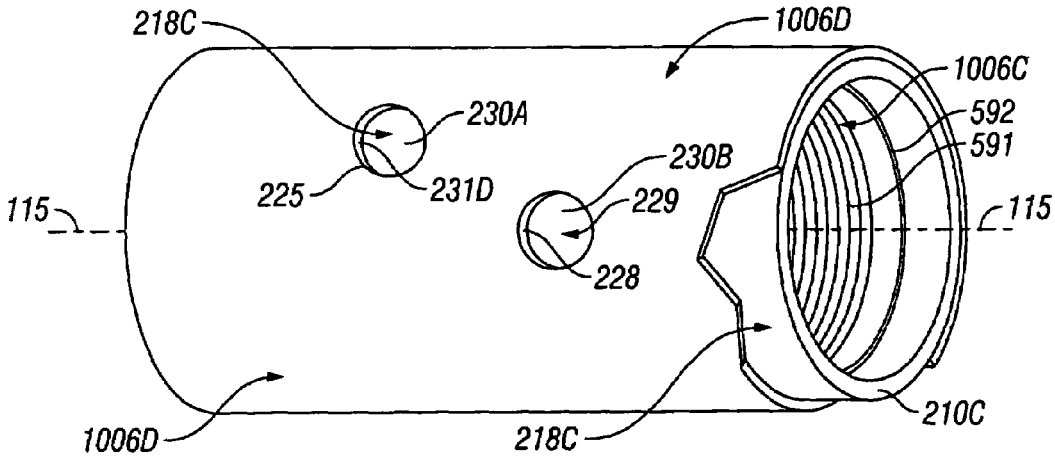
FIG. 5 illustrates a cross section view of the layered wall construction of the gun of the invention.

FIG. 5 illustrates the primary "tube-within-a-tube" design. The outer layer 1006D is a layer or tube in which holes 230A and 230B have been cut through the thickness of the layer wall 231D. The diameter of the outer layer 1006D is approximately equal to the outer diameter of the adjacent layer.

In the embodiment illustrated in FIG. 5, no holes are cut through the walls of the adjacent inner layer 1006C. Therefore, the combined layer, comprising the "tube-within-a-tube" of 1006D and 1006C, has the approximate physical shape of the prior art single walled gun having recesses or scallops machined into the outer surface of the wall.

In a preferred embodiment of the invention, holes 230A and 230B are cut through the outer layer 1006D prior to assembly of the two layers.

Figure 6:
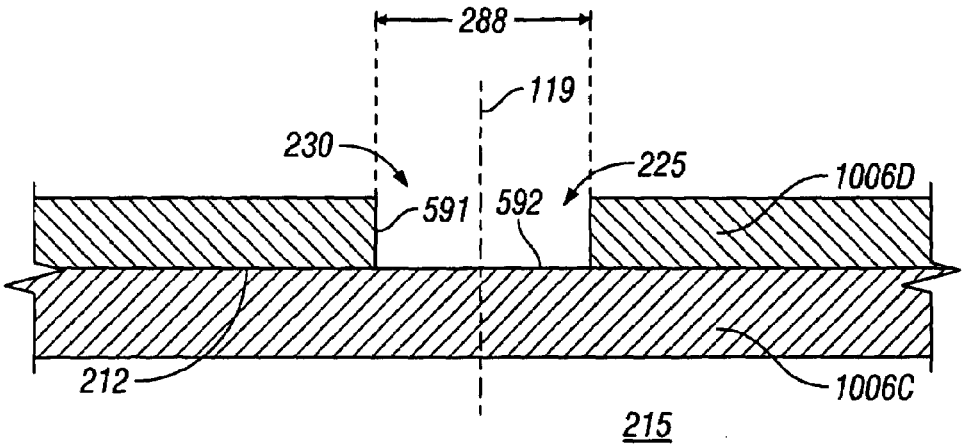
FIG. 6 illustrates a detailed embodiment of the invention employing laminates for extra strength.

FIG. 6 shows a portion of the inner layer 1006C and its relationship with the outer layer 1006D and annulus 215. The illustration does not; however depict the radial curvature of each layer. The diameter of the hole 288 may be varied. The axis 119 of the resulting hole 230 may be orthogonal to the longitudinal axis. It will be appreciated that the resulting recess 225 is comparable to the recess or scallop 220 machined into the gun wall 210 of the earlier FIGS.

It will be readily appreciated that the composition of the several layers or layers might differ. Also the thickness and number of layers might be varied, depending upon the requirements of the specific application. The cutting of holes can be accomplished before assembly, thereby eliminating the need for machining.

FIG. 6 also illustrates the ability to perform machining or other fabrication on the individual layers prior to assembly into the completed unit. For example, machining of connector structures can be performed on the inner layers individually prior to being inserted or pulled into the larger layers. These structural components may be machined threads, seal bores, etc. FIG. 6 illustrates a design that incorporates a machined connection end components 591 and 592 on the innermost layer of a multilayered tube construction.

As discussed above, it is not necessary that the interface of the surfaces of the inner and outer layers be bound or otherwise mechanically attached together. An advantage to this design is its simplicity and ease of manufacture. Each of the layers may have different chemical and mechanical characteristics, depending on the performance needs of the perforation work. Alternatively, each layer can be made of the same material.

In another variation, layers can be made of the same material but oriented differently to achieve the desired properties (similar to the mutually orthogonal layering of plywood).

One further variation can be implemented by offsetting a seam of each layer in the manufacturing process by rolling flat material into a tubular shape.

One variation of the invention can include an inner layer of high-strength material (such as the high-strength, alloy metals currently used for guns) and an outer tube of mild steel.

Figure 7:
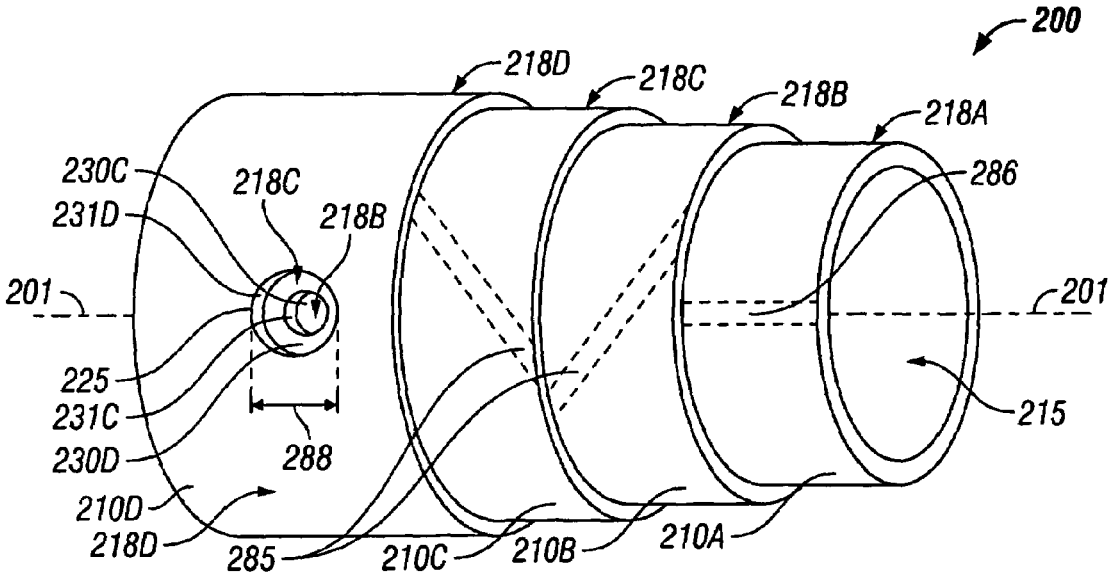
FIG. 7 illustrates a detailed embodiment of the invention employing energy absorption zones between the layers of the gun wall according to the invention.

FIG. 7 illustrates an embodiment of the invention in which tile gun has four material layers (210D, 210C, 210B and 210A). The invention, however, is not limited to four layers. The multilayer design might consist of "tube-within-a-tube" fabrication or the wrapping of material around the outer surface of an inner tube maintaining a relative uniform radius about a central axis 201. The inner tube defines the area of the tube annulus 215. The layers may be seamless or rolled. It will be readily appreciated that layering material can be wrapped in various orientations 285 and 286 to provide enhanced strength.

Two layers 210C and 210B are shown helically wrapped 285 at a radius around the longitudinal axis 201. The next inner layer 210A is shown comprised a rolled tube having a seam parallel to the longitudinal axis. It will also be appreciated that the wrapping might include braiding or similar woven construction of material. FIG. 7 also illustrates that any given layer 210C and 210B might consist of a material "tape" wrapped around an inner tube or layer 210A. The inner most layer 210A may also be formed around a removable mandrel (not shown). The laminations can consist of other metals or non-metals to obtain desirable characteristics. For example, aluminum is a good energy absorber, as is magnesium or lead. This invention does not limit the material choices for the lamination layers or the manufacturing method in obtaining a layer; it specifies of that layers exist and provide advantages over single-wall, monolithic gun designs.

Also illustrated in FIG. 7 are one or more layers 210D and 210C containing holes 230D and 230C having diameters cut prior to assembly. The hole 230D cut into the outer tube 210D has a diameter 288. The axis of the holes can be orthogonal to the longitudinal axis 201 of the gun 200. The tube layer thickness 231D and 231C forms the wall of the recess 225 and the outer surface 218B of the next underlying layer 210B forms the bottom of the recess 225. The architecture of the resulting recess is comparable, but advantageous to, the prior art machined scallops.

Wrapping designs and fabrication techniques allow far greater numbers of metals and non-metallic materials to be used as lamination layers, thereby achieving cost savings and reducing production and fabrication times. Improved rupture protection can be achieved without increasing the weight or cost.

Figure 8:
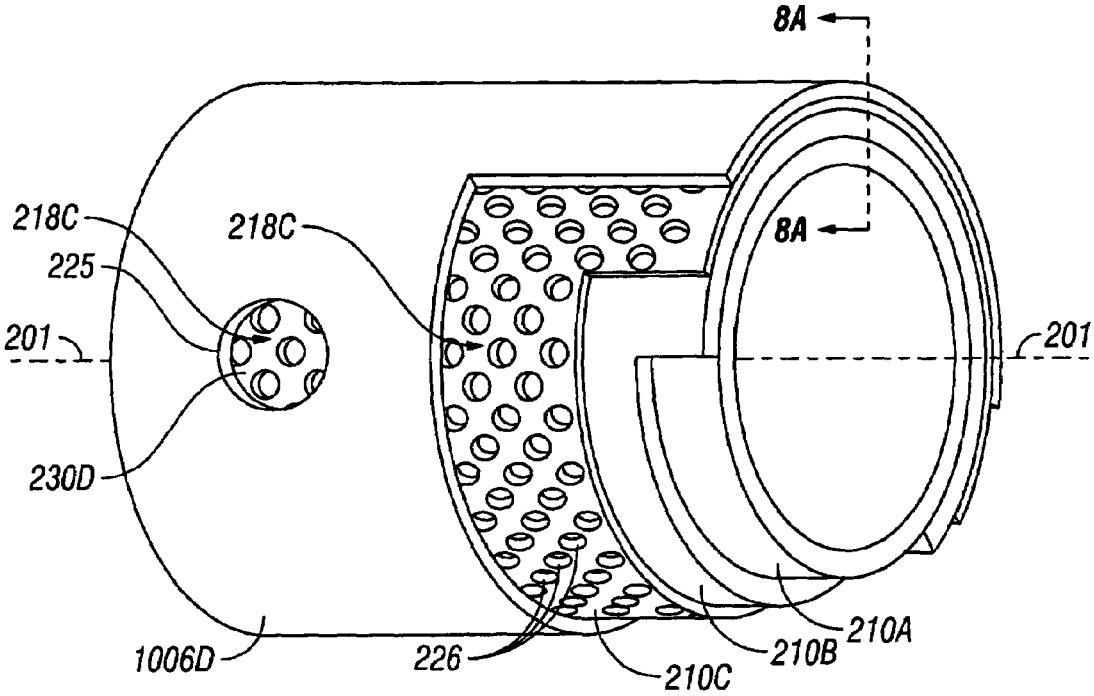
FIG. 8 illustrates an embodiment of the invention utilizing wrapped layer wire around the inner most layer according to the invention.
Figure 8A:
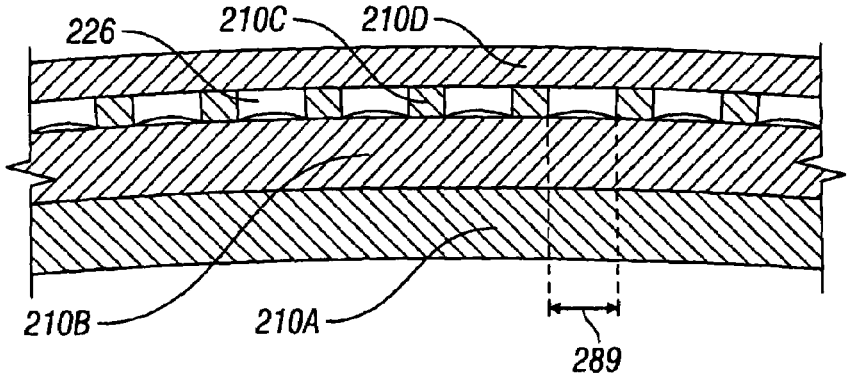

FIG. 8 illustrates how a perforated or non-continuous material can produce a lamination layer, even though voids may exist within that layer. The layers might consist of continuous sheets with regular perforations, woven sheets of wire, bonded composites, etc. An energy absorption layer 210C contains numerous perforations 226 each having small diameter 289. In another embodiment, not shown, the voids might contain material contributing to material strength at ambient temperature and pressure, but that is readily vaporized by the explosive high-temperature and high-pressure energy pulse, thereby providing minimal energy impedance proximate to the explosive charge, recess and well casing, but maximum shock absorption in other portions of the gun not immediately subjected to the directed high temperature explosive gas jets.

The energy absorption layer 210C illustrated in FIG. 8 has mechanical properties permitting the inner layers 210B and 210A to expand into the volume occupied by the absorption layer in response to the high impact outward traveling explosive energy pulse occurring upon charge detonation. This mechanical action will consume energy that might otherwise contribute to a catastrophic failure of the outer layer 1006D. As already discussed, such failure can hinder the intended perforation of the well casing and the surrounding geologic formation (not shown) or hinder the removal of the gun from the well. These mechanical property enhancements allow higher strength, thinner wall perforating guns with high impact resistance and energy absorption.

In addition to the specific energy absorbing layer shown in FIG. 8, it will be appreciated that each layer could provide strength or other properties specifically selected by the design engineer to meet conditions of an individual well bore. Therefore, this invention allows wall thickness and composition to become design variables without needing mill runs or large quantities of material.

FIG. 8 also illustrates a recess 225 in the gun wall 210 fabricated from hole 230D cut through selected layers 210D prior to assembly of the combined tubes. The outer surface 218C forms the bottom of the precut recess 230D.

FIG. 8 illustrates an embodiment using helically wound fiber or wire 397 and 398 around an inner layer 210A. The wrapping can also be performed utilizing a removable mandrel. The wrapped layers 210B and 210C can be combined with tubes or cylindrical layers 210A and 210D. The tube layers can incorporate precut hole 230 in the outer layer 1006D. The winding may be performed prior to placement of the next outer layer. The fiber or wire can be high strength, high modulus material. This material can provide strength against the explosive pulse. The diameter of fiber or thickness of wrapping can be varied for specific job requirements. The geometry of the winding (or braiding) can be varied, particularly in regard to the orientation to the longitudinal axis 201.

Figure 9:
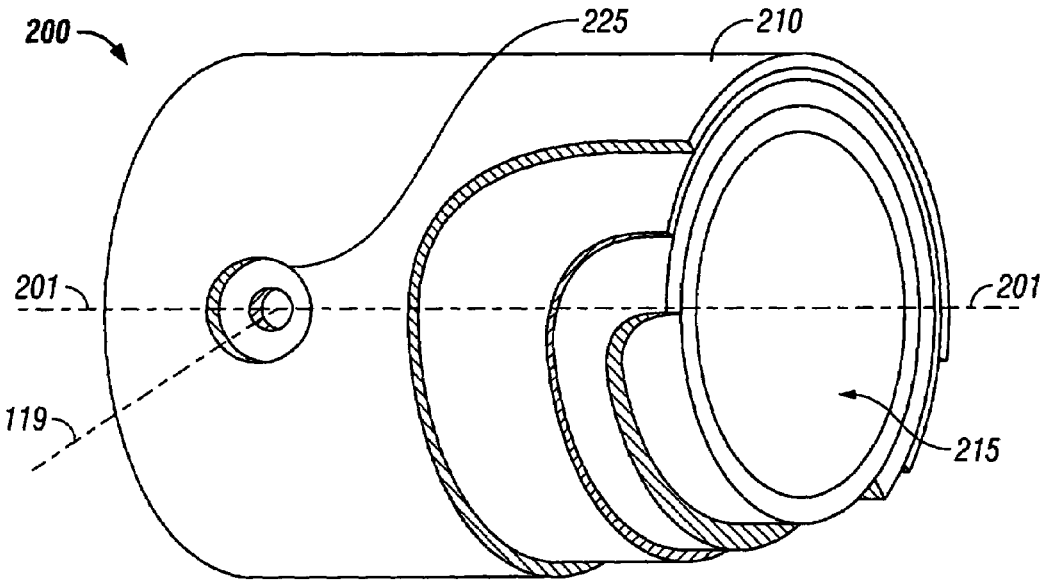
FIG. 9 illustrates various designs for precut recesses in gun wall layers.
Figure 9A:
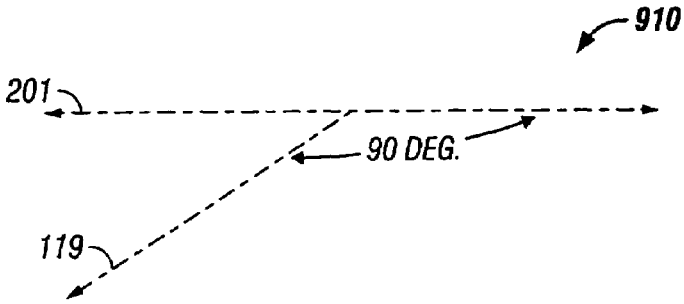

FIG. 9 illustrates a complex gun 200 formed from multiple layers or tubes radially aligned around a longitudinal axis 201. The wall 210 of the gun 200 forms a housing around an annulus 215. The explosive charges, detonator cord, and carrier tube can be placed within this annulus 215. Also illustrated is a recess 225 formed in the manner described previously. The center axis 119 of the illustrated recess 225 is orthogonally oriented 910 to center axis of the gun 201.

Figure 10A:
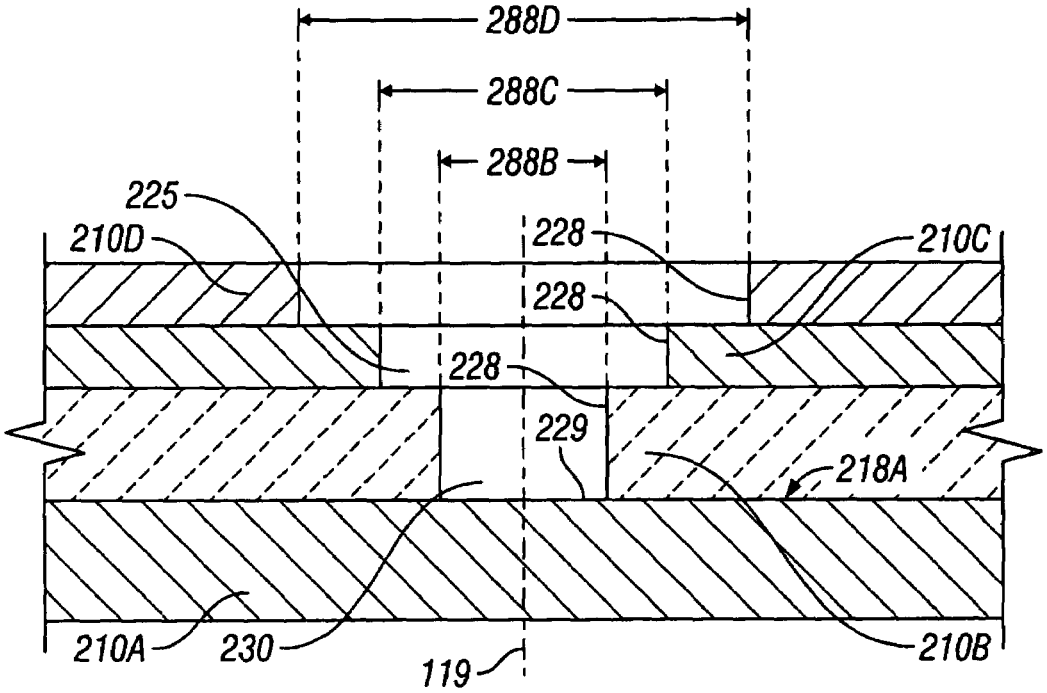
FIG. 10A–10F illustrates a side sectional view of the invention with a scallop configuration and a multilayered gun wall.

FIG. 10A illustrates an embodiment of the invention wherein the outer three layers 210D, 210C and 210B of the gun wall 210 contain holes cut prior to assembly of the tubes into a single layer. Although the diameter 288D, 288C and 288B of each hole is different, the center axis 119 of the combined holes 230 are aligned. The inner layer 210A is not cut, and the outer surface 218A of that tube forms the bottom 229 of the resulting recess 225. The thickness of each precut layer creates a stepped wall 228 of the recess.

Figure 10B:
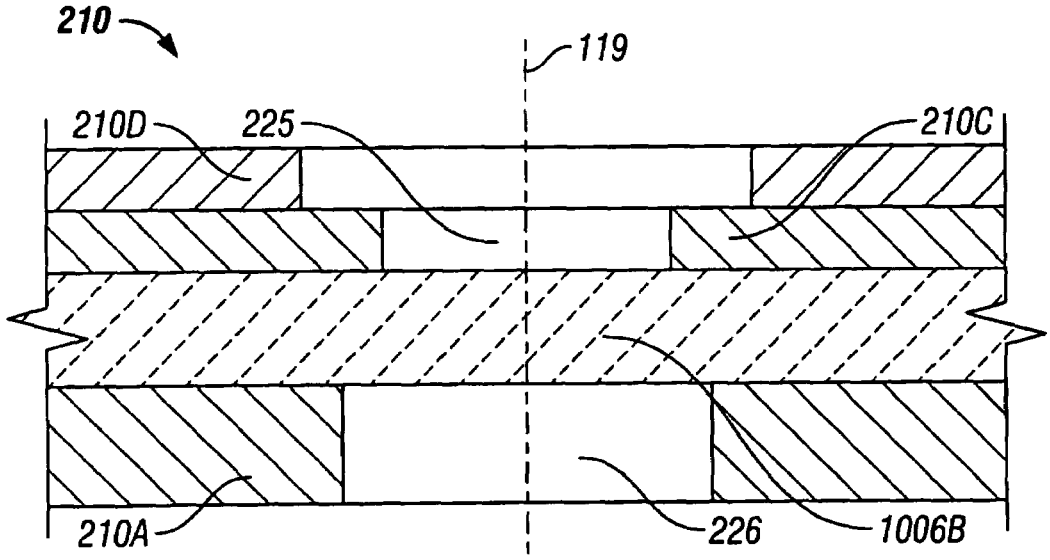

FIG. 10B illustrates another embodiment wherein the inner tube layer 210A is cut through prior to assembly, a next outer layer 1006B is not cut at the location, but the next outermost layers 210C and 210D are cut through and the center axis of the precut holes are aligned 119. This architecture achieves an inner recess 226 within the gun wall 210 aligned with an outer recess 225. This architecture or structure can be readily achieved by this invention. This structure cannot be practically achieved by the prior technology.

Figure 10C:
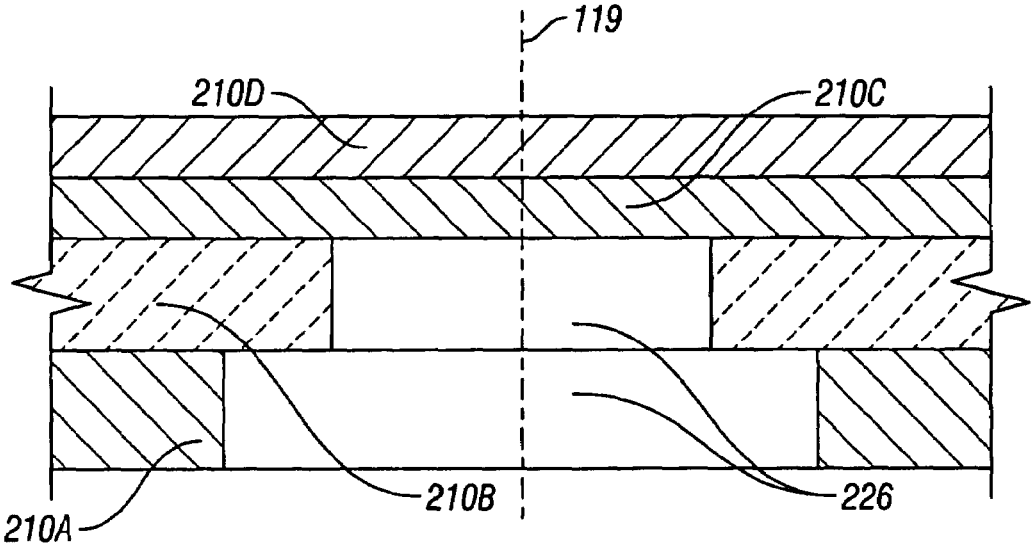

FIG. 10C illustrates another embodiment readily achieved by the invention, but that is not practicable by prior technology. It will be appreciated that the shape of the interior recess 226 can be varied in the same manner as the outer recesses may be formed. Accordingly, the recess diameter can be varied within the interior of the gun wall 210.

Figure 10D:
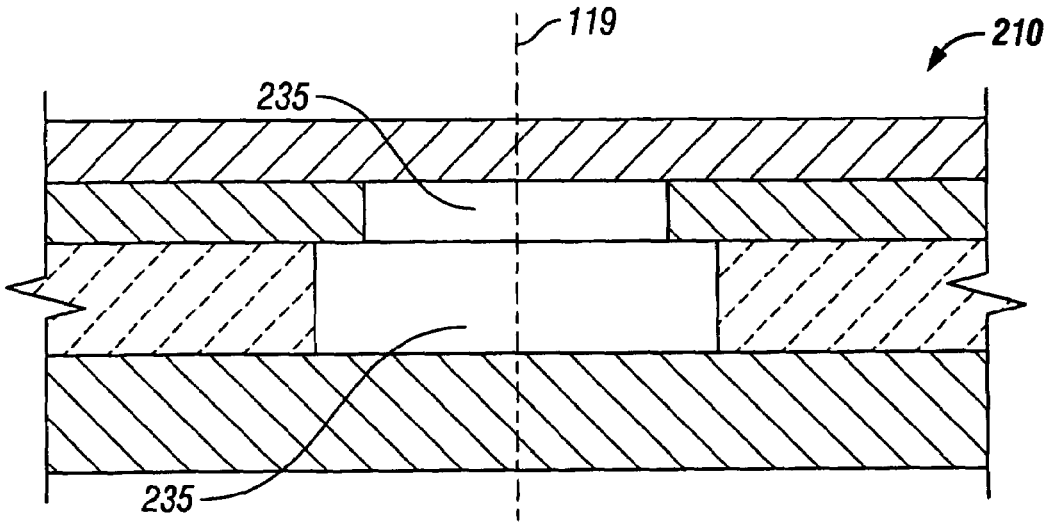

FIG. 10D illustrates a structure that has not been possible prior to the invention. The gun wall 210 can contain an interior recess or cavity 235. The radial axis 119 of the cavity can be aligned with an explosive charge. At the time of assembly, the cavity may be filled with a euctectic material or other material selected to provide strength at ambient conditions but disperse, vaporize or otherwise degrade with the rapid explosive energy pulse.

Figure 10E:
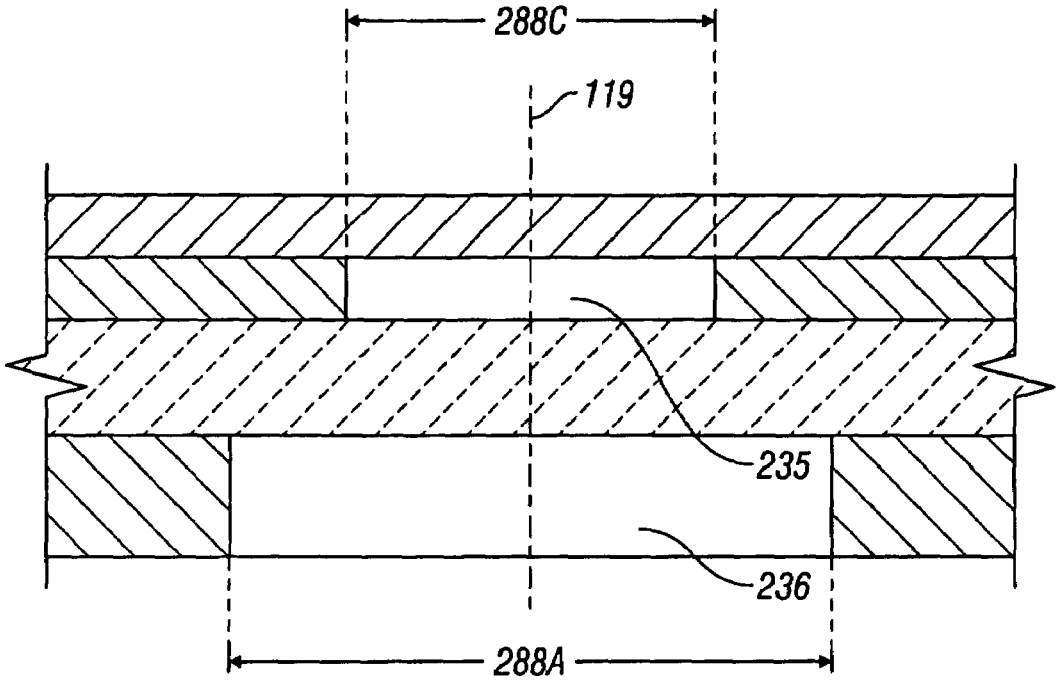

FIG. 10E illustrates a combination interior recess 236 with an internal cavity 235. The interior recess diameter 288A and the internal cavity diameter 288C may be varied as selected by the gun designer.

It will be readily appreciated that the dimensions of each precut hole can be specified. This ability can achieve recesses within multiple layers that, when assembled into the composite gun, the recess walls may possess a desired geometry that may enhance the efficiency of the explosive charge or otherwise impact the directionality of the charge.

Further, it will be appreciated that interior recesses may be filled with materials that, when subjected to high temperature, rapidly vaporize or undergo a chemical reaction enhancing o contributing to the original energy pulse.

Figure 10F:
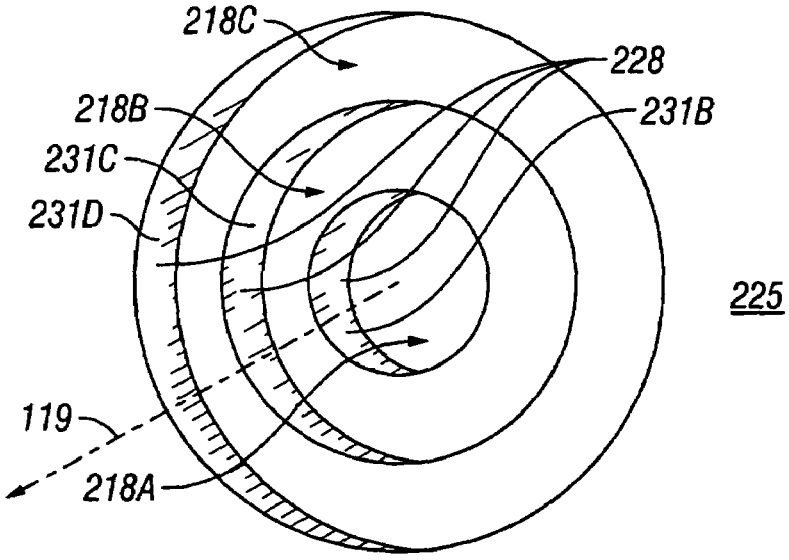

FIG. 10F is a detail of a complex recess 225 comprised of precut holes of varying diameters and aligned in relationship to the same radial axis 119. It will be appreciated that the illustrated recess may comprise part of an internal wall cavity (similar to that depicted in FIG. 10D) or a recess on the interior gun wall (similar to that depicted in FIG. 10C). It will be appreciated that the recess illustrated in FIG. 10F contains stepped walls 228, 231B, 231C, and 231D having increasing diameter outward along the axis 219. The outer gun wall is comprised of the surface 218D of the outer layer 1006D. The bottom of the recess is formed by the outer surface 218A of inner layer 210A.

Figure 11:
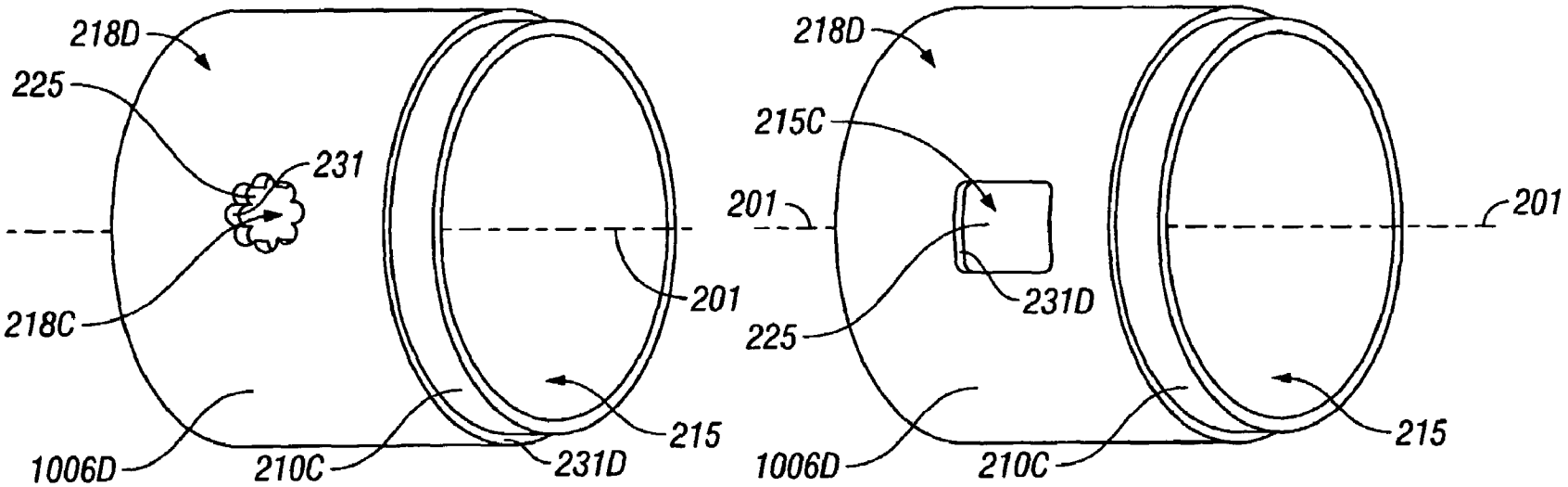
FIG. 11 illustrates an embodiment wherein end fittings are attached to the walls of the perforating guns subject of the invention.

FIG. 11 illustrates precut holes forming recesses 225 in the outer layer 1006D of the multi-layered gun wall (210D and 210C) having predefined complex outside wall shapes alternative to the circular shaped precut hole. The layer thickness 231D and surface 218D and 218C as well as the annulus 215 and longitudinal axis 201 are also shown. Actual shape design is unlimited since design is no longer restricted by conventional machining methods. Any combination between layers (such as the example shown in FIGS. 10A through 10F) and any shape (such as the example shown in FIG. 11) can be easily produced by laser cutting, tube assembly or layer lamination, and any required material wrapping.

An additional advantage of the invention is fewer "off-center" shot problems and better charge performance due to scallop wall orientation since the outer tube's recess 229 can achieve a constant underlying wall thickness 210B regardless of the explosive jet 251 exit point.

Figure 12:
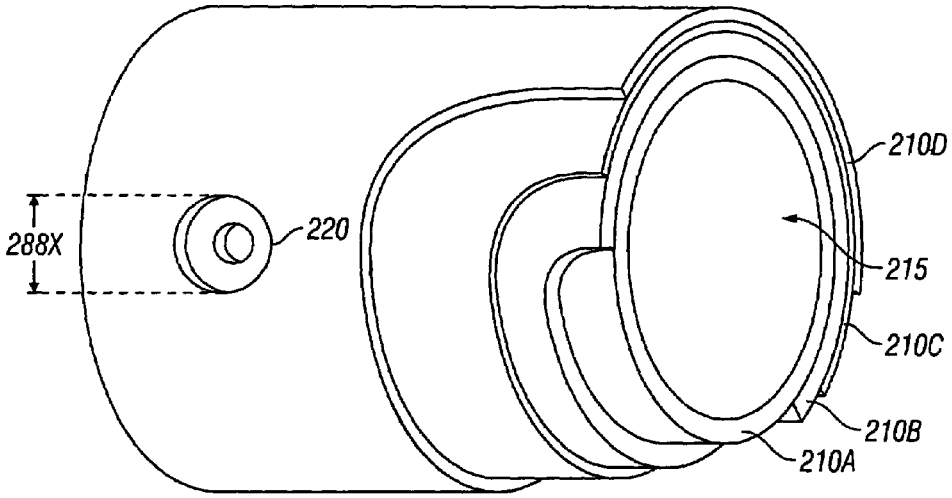
FIG. 12 illustrates the prior art machined scallop having a constant diameter.

In comparison, FIG. 12 illustrates the prior art machined scallop 220 having a constant diameter 288X. The bottom of the scallop 229X is flat and of non uniform thickness. It will be appreciated that if the explosive pulse of the detonated charge is not oriented perpendicular to the outside gun wall, the brief explosive jet pulse will encounter a non uniform gun wall, thereby creating a disruption or turbulence in the flow with resulting dissipation of energy. The invention subject of this disclosure results in a uniform wall thickness, thereby minimizing energy dissipation.

FIG. 12 illustrates the constant angle 289D and 289C of the recess side wall 228D and 288C oriented to the centerline 119 achieved by this invention. Unlike the prior art technology of milling scallops into solid monolithic tube wall, the radial orientation of the recess side wall formed by the invention can be maintained constant to a point on the longitudinal axis. The cut hole results in a removal of an arc segment 289D and 289C from the circumference of the layer or tube wall 210D and 210C. The angle can be varied by the length of the arc segment 289D and 289C cut relative to the diameter of the tube layer (or radial distance from the center axis of the gun). It will be appreciated by persons skilled in the technology that the angle can facilitate the accuracy or efficiency of the explosive charge. This angle may minimize interference or disruption of the explosive gas jet 251 through the gun toward the casing and strata. The prior art scallops generally have a fixed orientation to the center axis of the scallop 119. However, this fixed dimension creates a non uniform orientation to the center axis of the gun or the explosive charge positioned within the annulus 215 and proximate to the center axis.

FIG. 12 illustrates the gun wall recess 225 of the present invention may also achieve variable side wall angles 0 289D. The relationship of the precut hole diameter 288D to the side wall angle and to the center axis 201 of the gun, as well as the annulus 215 is also shown. The curvature of the bottom surface 218C of the recess 225 is also illustrated.

Figure 13A:
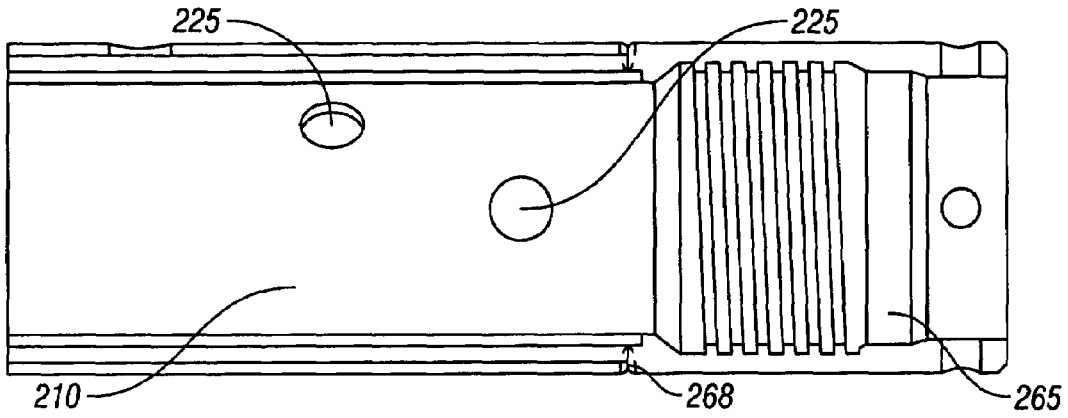
FIGS. 13A and 13B illustrate a weld seam connecting components to multiple layers of gun wall requiring less machining.
Figure 13B:
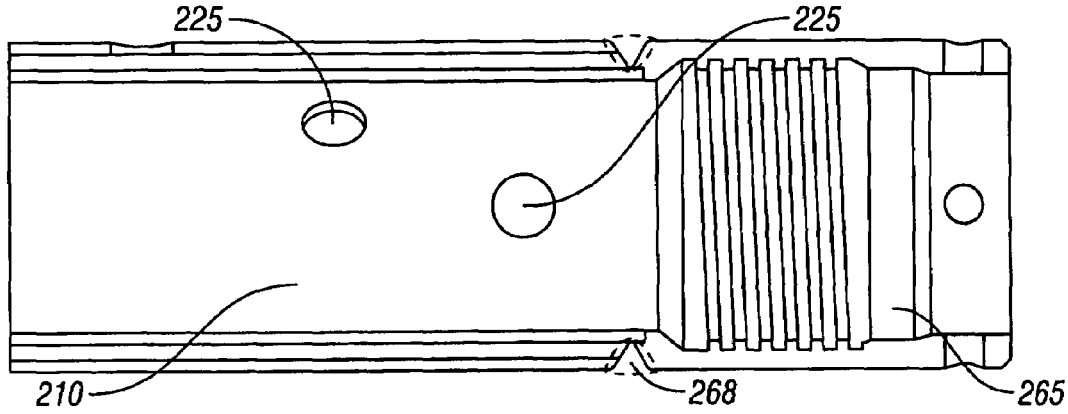

FIG. 13A illustrates a weld seam 268 connecting components 265 to multiple layers of gun wall 210 requiring less machining. This weld can be performed by laser welding, similar to techniques available for precutting of holes 225 within the gun wall 210. The weld seam 268 illustrated in FIG. 13B depicts the size achieved by conventional well technology.

In some embodiments, it may be advantageous to weld or mechanically attach machine threaded connection ends to at least one tube layer. FIG. 13A and FIG. 13B illustrates use of laser welding gun connection fittings for designs utilizing multiple layers. Laser welding involves low-heat input process, thereby allowing completed machined connection end turnings to be welded directly. Conventional multi-pass welds may require machining after welding to eliminate the effects of distortion.

As described above, the invention specifically includes and embodiment of a perforating device, such as a gun, which has a longitudinal axis and a horizontal axis and a loading tube having an explosive charge; a first layer slidable, non fixedly and removeably disposed over the loading tube; and at least one outer wire layer wound over the first layer and wherein said outer layer is wire.

In this embodiment, the wire is wound around the first layer at an angle between 1 degree and 60 degrees from the horizontal axis of the perforating device and wherein the wire is wound such that adjacent wire is in a parallel relationship.

Alternatively, the outer wire layer can be wire cloth. As wire cloth it is contemplated that the wire forms into a mesh with a mesh size between 4 wires per inch and 150 wires per inch, and a wire diameter between 0.015 inches and 1.088 inches.

Preferably, the wire is a metal. A binder or laminating agent can be disposed between the wire and the first layer. Alternatively, the wire can be welded to the first layer.

A third layer can be disposed between the first layer and the outer wire layer. This third layer can be a perforated sheet comprising a plurality of holes, wherein the holes comprise a diameter between 0.020 inches and 1 inch, and a density of approximately 1 hole per inch to 700 holes per inch. Alternatively, the third layer can be a solid sheet. A fourth layer can be disposed between the third layer and the outer layer. The fourth layer can be a solid material.

An energy absorbing layer can be disposed between the wire and the first layer. This energy absorbing layer can be a perforated sheet made from steel, stainless steel, aluminum, alloys of steel, alloys of stainless steel, alloys of aluminum and combinations thereof. A preferred density per inch for the perforated sheet is between 1 hole per square inch and 700 holes per square inch wherein the diameter of the holes ranges between 0.020 inches and 1 inch.

For this embodiment, the first layer can be a metal with a tensile strength between 36 ksi and 400 ksi, such as a chrome alloy, a nickel alloy, a steel alloy and combinations thereof.

In yet another embodiment, the first layer and the outer wire layer can be of the same material.

In yet another embodiment, the outer diameter of the wire is between 0.015 inches to 0.188 inches.

What is claimed is:

1. A perforating device having a longitudinal axis comprising:

a. a loading tube having an explosive charge;

b. a first layer slidable, non fixedly, and removeably disposed over the loading tube; and c. at least one outer layer in fixed engagement over the first layer and wherein said outer layer is a solid structure; and d. at least one third layer, wherein the third layer is disposed between the first layer and the outer layer, wherein the third layer is a perforated sheet comprising a plurality of holes, wherein the holes comprise a diameter between 0.020 inches and 1 inch, and comprise a density approximately 1 hole per inch to 700 holes per inch.

2. The device of claim 1, wherein the at least one outer layer comprises scallop openings disposed in the solid structure and said scallops are positioned in the solid structure in a defined pattern and wherein the orientation of the outer layer is parallel to the longitudinal axis of the perforating device.

3. The device of claim 2, wherein the defined pattern is a helical pattern or a linear pattern.

4. The device of claim 2, wherein the scallop openings are holes, and wherein at least 1 scallop per foot to 21 scallops per foot are disposed in the solid structure, and each hole has a diameter between ¼ inch and 1.5 inches.

5. The device of claim 1, further comprising a binder or laminating agent disposed between the layers.

6. The device of claim 1, wherein the outer layer is welded to the first layer.

7. The device of claim 1, wherein at least a fourth layer is disposed between the third layer and the outer layer.

8. The device of claim 7, wherein the fourth layer is a solid material.

9. The device of claim 7, wherein an energy absorbing layer is disposed between two layers.

10. The device of claim 9, wherein the energy absorbing layer is a perforated sheet.

11. The device of claim of claim 10, wherein the perforated sheet comprises a member of the group: lead, magnesium, copper, steel, stainless steel, aluminum, and alloys thereof.

12. The device of claim 10, wherein die density per inch for the perforated sheet is between 1 hole per square inch and 700 holes per square inch wherein the diameter of the boles ranges between 0.020 inches and 1 inch.

13. The device of claim 9, wherein the energy absorbing sheet is a solid sheet comprising a member of the group lead, magnesium, copper, aluminum, and alloys thereof and a non-metallic substance.

14. The device of claim 13, wheein the nonmetallic substance is selected from the group consisting of paper, cardboard, pressure laminate composite, and combinations hereof.

15. The device of claim 7, wherein the first and outer layers comprise the same material.

16. The device of claim 1, wherein the first and outer layers comprise a metal with a tensile strength between 36 ksi and 400 ksi.

17. The device of claim 16, wherein the metal comprises a member of the group: a chrome alloy, a nickel alloy, a steel alloy, and combinations thereof.

18. A perforating device having a longitudinal axis comprising:

a. a loading tube having an explosive charge;

b. a first layer slidable, non fixedly, and removeably disposed over the loading tube; and c. at least one outer layer in fixed engagement over the first layer and wherein said outer layer is a solid structure;

d. at least one third layer, wherein a third layer is disposed between the first layer and the outer layer;

e. at least a fourth layer is disposed between the third layer and the outer layer; and f. a perforated sheet disposed between the first and second layers, wherein the density per inch for the perforated sheet is between 1 hole per square inch and 700 holes per square inch, wherein the diameter of the holes on the perforated sheet ranges between 0.020 inches and 1 inch.

19. The device of claim 18, wherein the at least one outer layer comprises scallop openings disposed in the solid structure and said scallops are positioned in the solid structure in a defined pattern, and wherein the orientation of the outer layer is parallel to the longitudinal axis of the device.

20. The device of claim 19, wherein the defined pattern is a helical pattern or a linear pattern.

21. The device of claim 19, wherein the defined pattern is a helical pattern or a linear pattern.

22. The device of claim 18, further comprising a binder or laminating agent disposed between the layers.

23. The device of claim 19, wherein the scallop openings are holes, and wherein at least 1 scallop per foot to 21 scallops per foot are disposed in the solid structure, and each hole has a diameter between ¼ inch and 1.5 inches.

24. The device of claim of claim 18, wherein the perforated sheet comprises a member of the group: lead, magnesium, copper, steel, stainless steel, aluminum, and alloys thereof.

25. The device of claim 18, wherein the first and outer layers comprise a metal with a tensile strength between 36 ksi and 400 ksi.

26. The device of claim 25, wherein the metal comprises a member of the group: a chrome alloy, a nickel alloy, a steel alloy, and combinations thereof.

27. The device of claim 18, wherein the first and outer layers comprise the same material.

28. The device of claim 27, wherein the at least one outer layer comprises scallop openings disposed in the solid structure and said scallops are positioned in the solid structure in a defined pattern, and wherein the orientation of the outer layer is parallel to the longitudinal axis of the device.

29. The device of claim 28, wherein the defined pattern is a helical pattern or a linear pattern.

30. The device of claim 28, wherein the scallop openings are holes, and wherein at least 1 scallop per foot to 21 scallops per foot are disposed in the solid structure, and each hole has a diameter between inch and 15 inches.

31. The device of claim 27, further comprising a binder or laminating agent disposed between the layers.

32. The device of claim 27, wherein at least a third layer is disposed between inner metal layer and the outer metal layer.

33. The device of claim 32, wherein the third layer is a perforated sheet comprising a plurality of holes, wherein the boles comprise a diameter between 0.020 inches and 1 inch, and a density of approximately 1 hole per inch to 700 holes per inch.

34. The device of claim 32, wherein at least a fourth layer is disposed between the third layer and the outer layer.

35. The device of claim 27, wherein an energy absorbing layer is disposed between two layers.

36. The device of claim 35, wherein the energy absorbing layer is a perforated sheet.

37. The device of claim of claim 36, wherein the perforated sheet comprises a member of the group: lead, magnesium, copper, steel, stainless steel, aluminum, and alloys thereof.

38. The device of claim 36, wherein the density per inch for the perforated sheet is between 1 hole per square inch and 700 holes per square inch, wherein the diameter of the holes ranges between 0.020 inches and 1 inch.

39. The device of claim 27, wherein the inner metal layer and the outer metal layer comprise a metal with a tensile strength between 36 ksi and 400 ksi.

40. The device of claim 30, wherein the metal comprises a member of the group: a chrome alloy, a nickel alloy, a steel alloy, and combinations threat.

41. The device of claim 27, wherein the inner metal layer and the outer metal layer comprise the same material.

* * * * *